US006981894B1

(12) United States Patent
Swantner

(10) Patent No.: US 6,981,894 B1
(45) Date of Patent: Jan. 3, 2006

(54) SPRING CLIP

(75) Inventor: Michael J. Swantner, Warren, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/983,176

(22) Filed: Nov. 5, 2004

(51) Int. Cl.
*H01R 13/60* (2006.01)

(52) U.S. Cl. ..... 439/567

(58) Field of Classification Search ..... 439/567
See application file for complete search history.

(56) References Cited

U.S. PATENT DOCUMENTS 4,943,244 A * 7/1990 Teck et al. ..... 439/567
6,086,418 A * 7/2000 Chang ..... 439/573
6,210,220 B1 * 4/2001 Zhu et al. ..... 439/567
6,379,181 B1 * 4/2002 Chang et al. ..... 439/567

* cited by examiner

*Primary Examiner*—Truc Nguyen
(74) *Attorney, Agent, or Firm*—William H. McNeill

(57) ABSTRACT

An assembly (10) comprises a base (12), a first body (14) projecting from the base (12) in a first direction (16); an opening (18) in the base adjacent (12) the first body (14); a second body (20) projecting from the base (12) in a second direction (22) and containing a slot (24); a spring-clip (30) comprising a substantially U-shaped body (32) having first and second legs (34, 36), connected by a bight (38), the first leg (34) being longer than the second leg (36); the first leg (34) including a cammed leading edge (40) and a locking aperture (42) and being fitted into the opening (18) and extending in the first direction (16); the second leg (36) being inserted into the slot (24) and including retention barbs (44) for maintaining the second leg (36) in the slot (24); and a third body (46) formed to mate with the first body (14), the third body (46) including a locking lug (48) that engages the locking aperture (42).

5 Claims, 2 Drawing Sheets

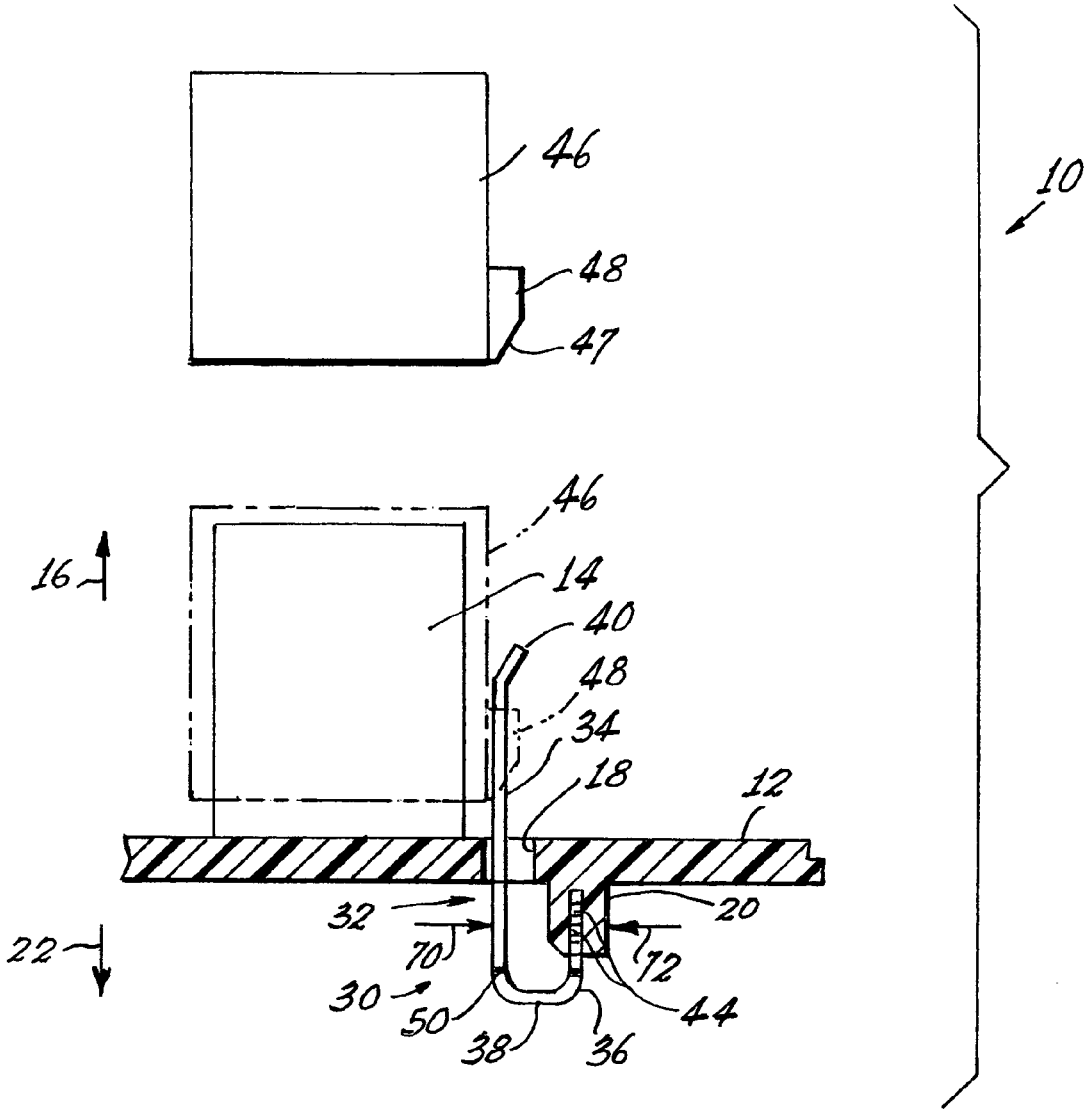
Fig. 1
Fig 4
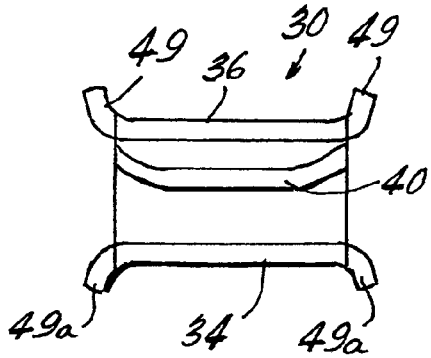

SPRING CLIP

TECHNICAL FIELD

This invention relates to multi-part assemblies and more particularly to such assemblies locked together with releasable spring clips. Still more particularly it relates to an unique spring clip ideally suitable for such purposes.

BACKGROUND ART

Many assemblies require mating parts in order to function properly. A particular non-limiting example of such assemblies includes electrical connectors used in places where they could be subjected to severe enough vibrations so as to cause the connectors to separate. Such separation could cause damage and even, perhaps, injury to persons associated with equipment using the connectors. To prevent such unwanted separation holding means such as bolts and nuts and various forms of spring clips are frequently employed. The use of bolts and nuts provides sure mating; however, they are time-consuming to install and they present problems in the event separation is required, for example, for repair purposes. The use of spring clips obviates some of the installation time problems but to date the spring clips utilized have been difficult to place and to maintain in a desired location.

DISCLOSURE OF INVENTION

It is, therefore, an object of the invention to obviate the disadvantages of the prior art.

It is another object of the invention to enhance mating assemblies.

Still another object is the provision of a spring clip that positions easily and is reliable in both its holding and releasing functions.

These objects are accomplished, in one aspect of the invention by an assembly comprising a base, a first body projecting from the base in a first direction; an opening in the base adjacent the body; a second body projecting from the base in a second direction and containing a slot; a spring-clip comprising a substantially U-shaped body having first and second legs connected by a bight, the first leg being longer than the second leg; the first leg including a cammed leading edge and a locking aperture and being fitted into the opening and extending in the first direction; the second leg being inserted into the slot and including retention barbs for maintaining the second leg in the slot; and a second body formed to mate with the first body, the second body including a locking lug that engages the locking aperture.

This assembly provides quick and secure connection yet allows for easy separation should that action be desired or necessitated.

BRIEF DESCRIPTION OF THE DRAWINGS

FIG. 1 is an elevational, exploded view, partly in section, of an assembly in accordance with an aspect of the invention;

FIG. 4 is a plan view of an alternate embodiment.

BEST MODE FOR CARRYING OUT THE INVENTION

Figure 2:
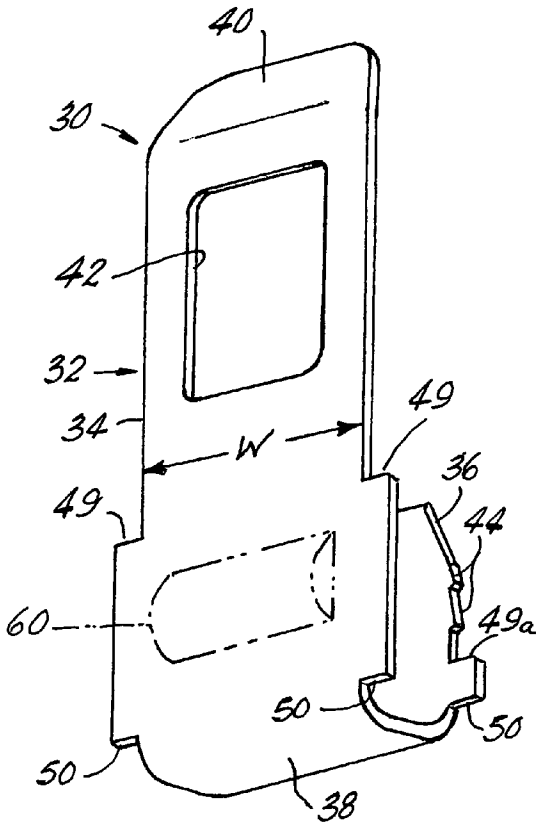
FIG. 2 is perspective view of a spring clip according to an embodiment of the invention from a first side.

For a better understanding of the present invention, together with other and further objects, advantages and capabilities thereof, reference is made to the following disclosure and appended claims taken in conjunction with the above-described drawings.

Referring now to the drawings with greater particularity, there is shown in FIG. 1 an assembly 10, for example, an electrical connector, comprising a base 12 having a first body 14 projecting therefrom in a first direction 16. An opening 18 is provided in the base 12 adjacent to the first body 14. A second body 20 projects from the opposite side of the base 12 in a second direction 22 and contains a slot 24.

Figure 3:
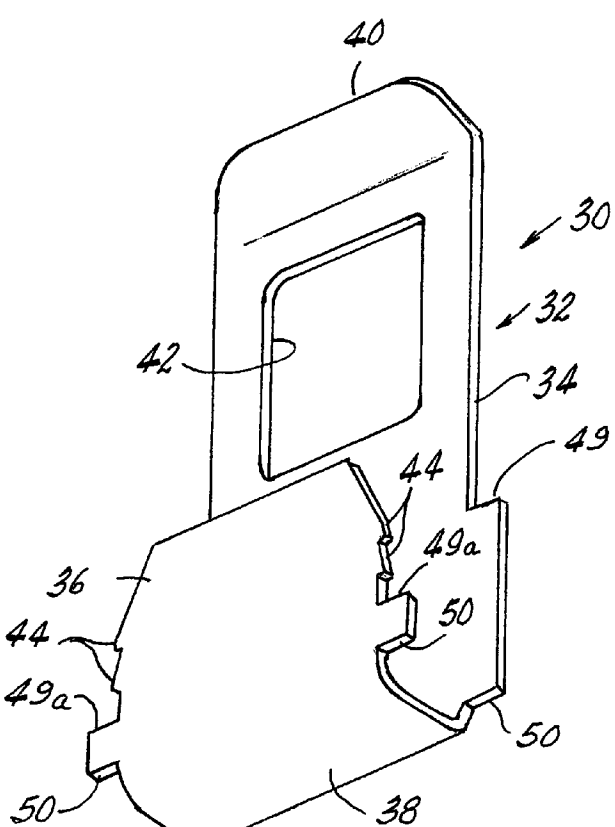
FIG. 3 is a similar view of a spring clip from a second side.

A spring-clip 30 for the assembly 10, seen most clearly in FIGS. 2 and 3, comprises a substantially U-shaped body 32 with first and second legs 34, 36, connected by a bight 38. The spring clip is preferably formed from type 301 stainless steel. The first leg 34 is longer than the second leg 36 and includes a cammed leading edge 40 and a locking aperture 42. The first leg 34 is fitted into the opening 18 and extends in the first direction 16.

The second leg 36 is inserted into the slot 24 and includes retention barbs 44 for maintaining the second leg 36 in the slot 24.

A third body 46 is formed to mate with the first body 14 by movement in the direction 22. The third body 46 includes a locking lug 48 with a cam surface 47 that engages the cammed leading edge 40 of the spring clip 30 forcing the spring clip away from its normal position until the locking lug enters the locking aperture 42, at which time the spring clip will resile, thereby fixing the first and second bodies together. FIG. 1 shows the third body 46 above the first body in solid lines and in its locked position in phantom lines. Under some conditions the third body 46 can be removed by applying pressure to the cammed leading edge 40 and bending leg 34 away from the third body 46 far enough to release the locking lug 48.

Alternatively, in the event that access cannot be obtained to the cammed leading edge 40, pressure can be applied to the lower portion of the spring clip 30 adjacent the bight 38 to cause the release of the locking lug 48, as shown by arrows 70, 72. Also, if necessary, a wedge or lever, such as a blade screwdriver, can be inserted between the leg 34 and the opening 18 to apply pressure against the leg 34 to effect release of the locking lug 48.

The first leg 34 contains a stop 49 for regulating the position of the spring clip 30 in the opening 18 and the second leg 36 contains a stop 49*a* for regulating the depth of insertion into the slot 24. The stop 49 on the first leg and the stop 49*a* on the second leg are at different distances from the bight 38 when measured in the first direction 16 to accommodate the differing levels between the bottom surface of the base 12 and the surface of the second body 20.

Further, the first leg 34 and the second leg 36 each include insertion aids 50, which can be opposite sides of projections containing the stops 49, 49*a*. An alternate embodiment of the stops and insertion aids is shown in FIG. 4, wherein the projections can be bent substantially normal to the plane of the legs. In each of the embodiments the legs 34, 36 have a given width, W, and the stops and insertion aids project beyond the given width.

If desired or necessary a reinforcing rib 60, shown in phantom lines in FIG. 3, can be formed in the first leg 34.

Thus there is provided a spring clip that positions easily and is reliable in both its holding and releasing functions.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An assembly comprising:

a base;

a first body projecting from said base in a first direction;

an opening in said base adjacent said body;

a second body projecting from said base in a second direction and containing a slot;

a spring-clip comprising a substantially U-shaped body having first and second legs connected by a bight, said first leg being longer than said second leg;

said first leg including a cammed leading edge and a locking aperture and being fitted into said opening and extending in said first direction;

said second leg being inserted into said slot and including retention barbs for maintaining said second leg in said slot; and a third body formed to mate with said first body, said third body including a locking lug that engages said locking aperture.

2. The assembly of claim 1 wherein first leg contains a stop for regulating the position of said spring clip in said opening.

3. The assembly of claim 2 wherein said second leg contains a stop for regulating the depth of insertion into said slot.

4. The assembly of claim 3 wherein said stop on said first leg and said stop on said second leg are at different distances from said bight when measured in said first direction.

5. The assembly of claim 1 wherein said first leg and said second leg each include insertion aids.

* * * * *